US005319861A

United States Patent [19]

Tate

[11] Patent Number: 5,319,861

[45] Date of Patent: Jun. 14, 1994

[54] DRYING METHOD AND DEVICE FOR COATED LAYER

[76] Inventor: Setsuo Tate, 21-3, Kasuga-2-chome, Bunkyo-ku, Tokyo, Japan

[21] Appl. No.: 792,158

[22] Filed: Nov. 14, 1991

[30] Foreign Application Priority Data

Nov. 16, 1990 [JP] Japan ..... 2-310916
Aug. 1, 1991 [JP] Japan ..... 3-216001

[51] Int. Cl.[5] ..... F26B 3/34

[52] U.S. Cl. ..... 34/267; 34/420; 34/273

[58] Field of Search ..... 34/1 W, 1 X, 41, 68, 34/18, 39, 40; 427/55, 372.2

[56] References Cited

U.S. PATENT DOCUMENTS

| | | | |
|---|---|---|---|
| 3,720,002 | 3/1973 | Martin | 34/18 |
| 3,973,328 | 8/1976 | Theobald | 427/55 |
| 4,336,279 | 6/1982 | Metzger | 427/55 |
| 4,535,548 | 8/1985 | Hyde | 34/4 |
| 4,863,375 | 9/1989 | Wu | 432/121 |

FOREIGN PATENT DOCUMENTS

| | | |
|---|---|---|
| 1-151873 | 10/1989 | Japan . |
| 2-43217 | 3/1990 | Japan . |

OTHER PUBLICATIONS

"Coating Technique", Oct. 20, 1990, published by K. K. Rikoh Shuppan (Science and Technology Company Inc.), pp. 211–213.

*Primary Examiner*—Henry A. Bennett
*Assistant Examiner*—Denise Gromada
*Attorney, Agent, or Firm*—Foley & Lardner

[57] ABSTRACT

A drying method and a device each employ a specific range of infrared radiation which has a high transmissivity relative to a coated layer formed on a metal substrate and a high absorptivity relative to the substrate. The energy transmitted through the coated layer is absorbed in the substrate and changed into heating energy to heat the substrate surface. The backsurface of the coated layer is also heated and solidified. The surface of the coated layer is solidified at the termination of the drying process so that surface is not injured by evaporation of solvent from the coated layer. A combination of infrared radiation and a blow of hot air ensures that the coated layer will not experience irregular heating which helps to prevent the generation of pin holes in the coated layer and shortens the drying period. The blowing direction is oriented in the same or at right angles to the infrared radiation.

28 Claims, 13 Drawing Sheets

CHARACTERISTIC CURVES OF NEAR IR LAMP / FOR IR LAMP (200V)

DRYING METHOD AND DEVICE FOR COATED LAYER

BACKGROUND OF THE INVENTION

1. Field of the Invention

The present invention generally relates to a drying method for various coated layers and a drying device therefor. Particularly, the present invention relates to a drying method and a drying device for various coated layers, which method utilizes specific spectrum infrared radiation, such as near infrared radiation, which has a high transmissivity relative to a coated layer on a substrate and a high absorbtivity relative to the substrate. More particularly, the present invention relates to a drying method and a drying device for various coated layers, which method utilizes a combination of near infrared radiation and the blowing of hot air.

2. Description of Prior Art

Conventionally, various drying methods employing a hot air furnace, a far infrared radiation furnace and the like have been well known and commonly used to dry a coated material on a substrate such as a metal plate and the like. The substrate provided with the coated material to be dried is referred to as a work, and the substrate per se is referred to as a method material in this specification. The drying process and the function of these drying methods have been understood as follows.

First, a work whose mother material is coated with a paint mainly composed of resin, such as an acrylic resin, is set in a furnace. The work is subjected to a blow of hot air or far infrared radiation. The solvent of the coated material is firstly evaporated from the work surface and the surface is gradually solidified while losing flowability from the surface layer. Further the solidification of the coated layer is accelerated by heating when the heat from the hot air is transmitted to the inside of the work; i.e., the mother material. On this occasion, the solvent existing in the inside of the surface is gasified and the solvent gas pierces through the solidified surface layer to evaporate from the work surface. Thus many fine pores and pin holes are generated in the work surface. In order to prevent the work surface from generating these pores and pin holes, conventional furnaces must be controlled to slowly increase the heating temperature after the solvent is evaporated from the work in a setting room.

These conventional drying methods employing such a process, require relatively long periods to complete the drying operation because the drying temperature must be kept at a low level to avoid generating the pores and pin holes. This is a serious problem to overcome. Particularly, in a specific type furnace employing a combination of infrared radiation and a blow of hot air for the purpose of a quick drying, the surface temperature of the work remarkably tends to be higher which causes the difference of temperature between the surface and the coated layer and the interface between the coated layer and the metal substrate. This temperature difference accelerates the generation of pores and pin holes in the coated layer.

In addition to the above conventional methods, various drying methods are disclosed in Japanese Patent Application for Utility Model, Laid-Open Publication No. 1-151873, entitled "Near Infrared Radiation Stove for Liquid and/or Powder Coatings"; Japanese Patent Application for Utility Model, Laid-Open Publication No. 2-43217, entitled "Light Panels for Exclusive Use in Furnace for Banking Coating Material"; and U.S. Pat. No. 4,863,375 entitled "Baking Method for Use with Liquid or Powder Varnishing Furnace". One of these documents relates to a baking method in a near infrared radiation stove for liquid and/or powder coatings. This method utilizes the properties of near infrared radiation such as quick heating at a high temperature with a remarkable penetration to improve the baking method in the stove so that the coated substance can be quickly dried and its adhesion can be also increased. In detail, liquid type or powder in liquid type coating material is applied on the surface of a substrate and is then subjected to a melt-heating work to realize a uniform coating layer on the substrate surface. Another document relates to a drying furnace employing a near infrared radiation whose light source is provided at its rear portion with a ceramic reflector containing a heater and a drying method which uses a drying furnace in which a high temperature section and a low temperature section are sequentially formed.

On the other hand, "medium wave infrared radiator" is disclosed in "Coating Technique" special October number, pp 211 to 213, issued on Oct. 20, 1990, published by K.K. Rikoh Shuppan (Science and Technology Publishing Company Inc.). This document teaches that radiated energy impacting on a coated layer is partially absorbed by the coated layer, reflected by the layer and transmitted through the layer, respectively. The absorbed energy changes to heat energy which causes the drying of coated layer. Further, the transmitted energy causes the substrate or the mother material of the coated layer to be heated so that the coated layer is heated from the inside.

Generally, physical properties of infrared radiation are known as follows.

(1) Near infrared radiation: temperature is 2,000° to 2,200° C. the maximum energy peak of the wave length is generated at about 1.5 μm, energy: density is high, reflected and transmitted energy are greater, rising speed is fast (1 to 2 sec), life time is short (about 5000 hours).

(2) Medium infrared radiation: temperature is 850° to 900° C., the maximum energy peak of the wave length is generated at about 2.5 μm, energy density is medium, absorbed energy and transmitted energy are balanced so that energy can be permitted into the inside of the coated layer, life time is long.

(3) Far infrared radiation: temperature is 500° to 600° C. the maximum energy peak of the wave length is generated at about 3.5 μm, energy density is low, energy is remarkably absorbed by the surface of the coated layer so that the surface tends to be heated, rising speed is slow (5 to 15 min), circulation loss is great.

In order to obtain a superior coating quality by using the medium wave length infrared radiation with its maximum efficiency, the following two conditions are satisfied at the same occasion.

1. Radiated energy from an infrared radiator varies as the fourth power rised value of the absolute temperature (T) of the radiator; $Eb \propto T^4$. In other words, the radiated energy is increased as the temperature of the radiator rises.

2. The maximum energy peak of the wave length is positioned a little to short wave length with respect to the peak absorptivity of the coated layer.

The maximum energy peak of the wave length of infrared radiation used in industrial scene for heating such coated layers is concentrated at about 3 μm without exception. Therefore, the infrared radiator having the maximum energy peak of the wave length at about 2.5 μm is preferable to use for effectively drying the coated layer by a combination of the absorbed energy and the transmitted energy which can effectively and uniformly heat the coated layer from its surface and backsurface.

The relation between the temperature (T) of the infrared radiator and its maximum energy peak of the wave length generated at λ m is represented by Wein's displacement law:

$$\lambda m = 2897/T$$

When the maximum energy peak of the wave length is generated at λ m 2.5, the above equation is rewritten as follows:

$$T = 2897/2.5 = (t + 273)$$

$$t = 880^\circ C.$$

Consequently, the maximum efficiency can be realized when the medium wave length infrared radiation is used while satisfying the above condition.

The above described conventional documents Japanese Patent Application for Utility Model, Laid-Open Publications No. 1-151873 and 2-43217, and U.S. Pat. No. 4,863,375, however do not teach any optimum conditions of the infrared radiation applied to the coated layer on a metal substrate. These conventional documents disclose use of near infrared radiation to dry coated layers and general explanation on the properties of the near infrared radiation to be used.

In the use of far and medium infrared radiation for drying coated layer, their wave range is so selected that the irradiated infrared energy is highly absorbed by the coated layer. This is for the purpose of heating from the layer surface. However, this will cause the generation of many pin holes or pores in the layer surface, and thus the period for drying the coated layer will be prolonged with keeping drying temperature at a low level to prevent the coated layer from generating pin holes or pores.

"Coating Technique Special October Number" does not teach any optimum conditions of infrared radiation according to a study on the absorptivity of the infrared radiation to the mother material and/or the cause of pin holes or pores generated in the coated layer. But this document gives the conclusion that the infrared radiator which provides the maximum energy peak of the wave length at about 2.5 μm is preferable because its radiated energy can be effectively absorbed and transmitted to heat the surface and backsurface of the coated layer.

The inventor of this application found out that the coated layer, can be prevented from having pin holes or pores during drying by preferring the use of near infrared radiation whose wave range can easily be transmitted through the coated layer rather than a wave range having a high:absorptivity relative to the coated layer. It can be supposed that the infrared radiation transmitted through the coated layer directly heats the substrate surface and not the layer surface and the coated layer is gradually dried from its backsurface by the heat.

In the case of the metal substrate, its reflectivity against infrared radiation is increased as the wave length of the infrared radiation is prolonged and its absorptivity for thermal energy is increased as the wave length becomes shorter. As a result, when near infrared radiation is used for drying coated layers, it can be supposed that the near infrared radiation having a high transmissivity to the coated layer; that is, a poor absorptivity to the coated layer is preferably used to prevent the coated layer from generating pin holes.

Conventional drying systems and devices are too large to apply a small scale drying work for a partial repair coating in a general paint-coating work, or in a panel processing work of vehicle body. In a conventional manner, a partially repaired product must be set again in the furnace which is designed for drying the product in an ordinary paint-coating process. Since this furnace is always controlled for drying a whole body of the product, it requires further time to adjust control parameters such as temperature and heating time for drying the repaired portion. If this drying system is arranged in an automatic controlled manufacturing line such as an automotive vehicle assembly line, this line must be stopped while the drying system is used for drying the repaired portion.

In an automotive vehicle manufacturing line, many infrared lamps generating far and near infrared radiation are used as a heating source in a drying process. Although this type of heating source can heat only irradiated portion, the outside of the irradiated portion is kept at a low temperature. The heating energy is transmitted to the low temperature portions which are not applied with infrared radiation and face the ambient air, and thus drying temperature becomes irregular. This will cause a low producing efficiency with a low quality.

BRIEF SUMMARY OF THE INVENTION

It is the object of the present invention to provide a drying method and a device for various coated layers provided on a substrate such as a metal plate, which method and device can dry the coated layers without generation of pin holes or pores.

Another object of the present is provide a drying method and a device for various coated layers provided on a substrate such as a metal plate, which method and device can effectively dry the coated layers in a relatively short period.

To accomplish the above described objects, a drying method and a device according to the present invention employ infrared radiation whose wave length is characterized in that transmissivity to the coated :layers is high and absorptivity to the substrate surface is high. The drying method and device according to the present invention preferably use near infrared radiation.

In the drying method and device according to the present invention, the infrared radiation transmitted through the coated layer is absorbed by the substrate and thus the substrate surface is heated by the absorbed energy. The coated layer is solidified from its backsurface by the heat at the substrate surface. The surface of the coated layer is solidified at the termination of this drying process so that the surface of the coated layer is not injured by evaporation of solvent from the coated layer.

Another aspect of the present invention is characterized in that the inventive drying method and device each employ a combination of using near infrared radiation having the above described character and a blow of hot air. This combination ensures that the irregularity of drying temperature and the generation of pin holes are completely eliminated and that drying time is shortened.

Other and further objects, features and advantages of the invention will appear more fully from the following description taken in connection with the accompanying drawings.

DETAILED DESCRIPTION OF THE PREFERRED EMBODIMENT

Figure 1:
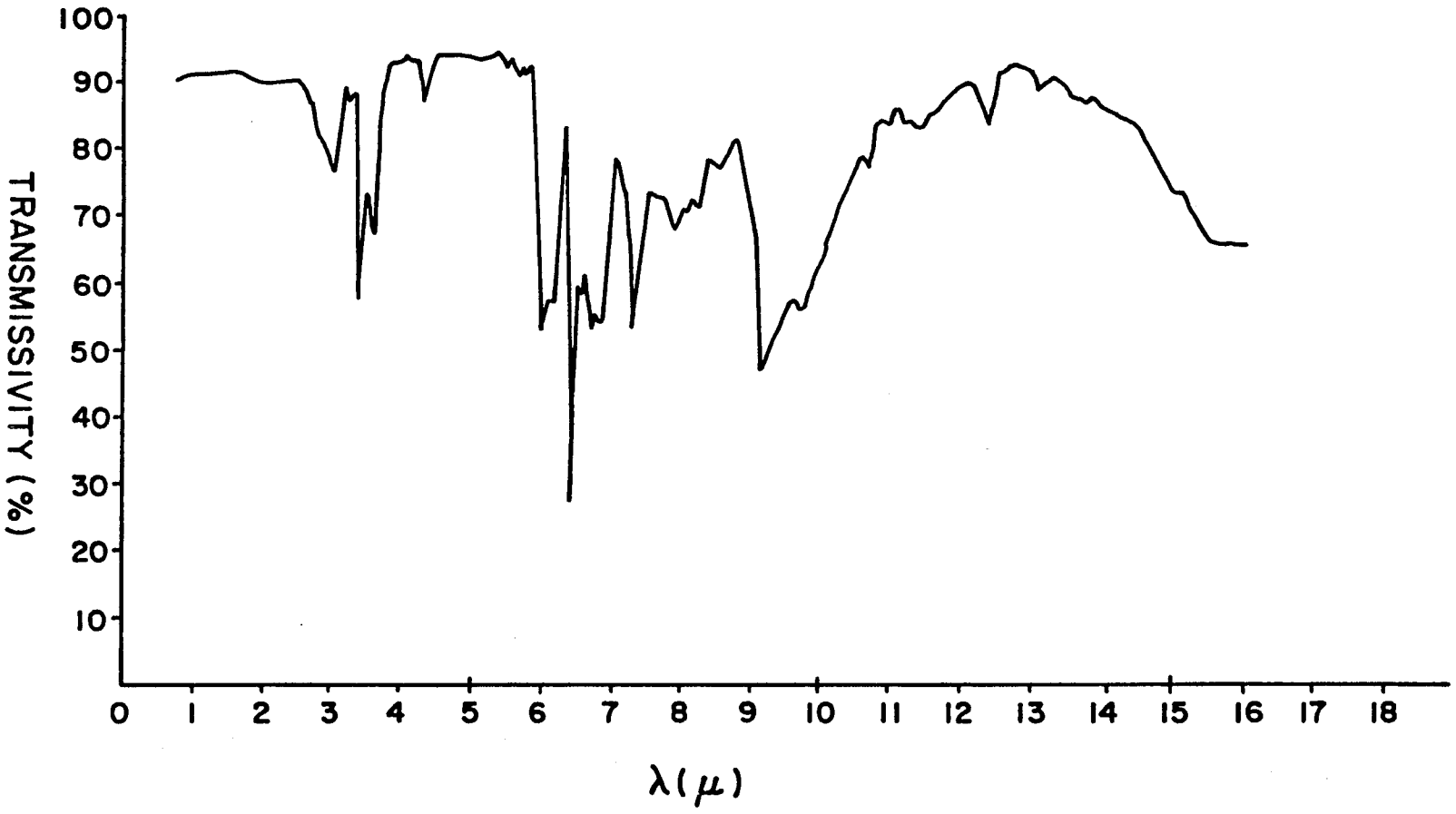
FIG. 1 is a characteristic curve showing an infrared spectrum of butyl urea - butyl melamine resin.

Referring to the drawings, a work 100 to be dried by the drying method and device according to the present invention includes a metal substrate and a coating material coated thereon.

The metal substrate is preferably selected from iron, aluminium, copper, brass, gold, beryllium, molybdenum, nickel, lead, rhodium, silver, tantalum, antimony, cadmium, chromium, iridium, cobalt, magnesium, tungsten, and so on. More preferably, copper, aluminium and iron are used for it.

The coating material is preferably selected from acrylic resin paint, urethane resin paint, epoxy resin paint, melamine resin paint and so on. The coating material is coated on the metal substrate by any conventional manner such as spray coating, roller coating, and so on. Further, the coated layer may be formed by a melt-deposition of powder coating material (polyester group, epoxy group, acrylic group and so on).

Tables 1 to 4 show reflectance of metals for various wave length, from the American Institute of Physics Handbook 6–120. Generally, absorptivity is inversely proportional to reflectance.

Figure 2:
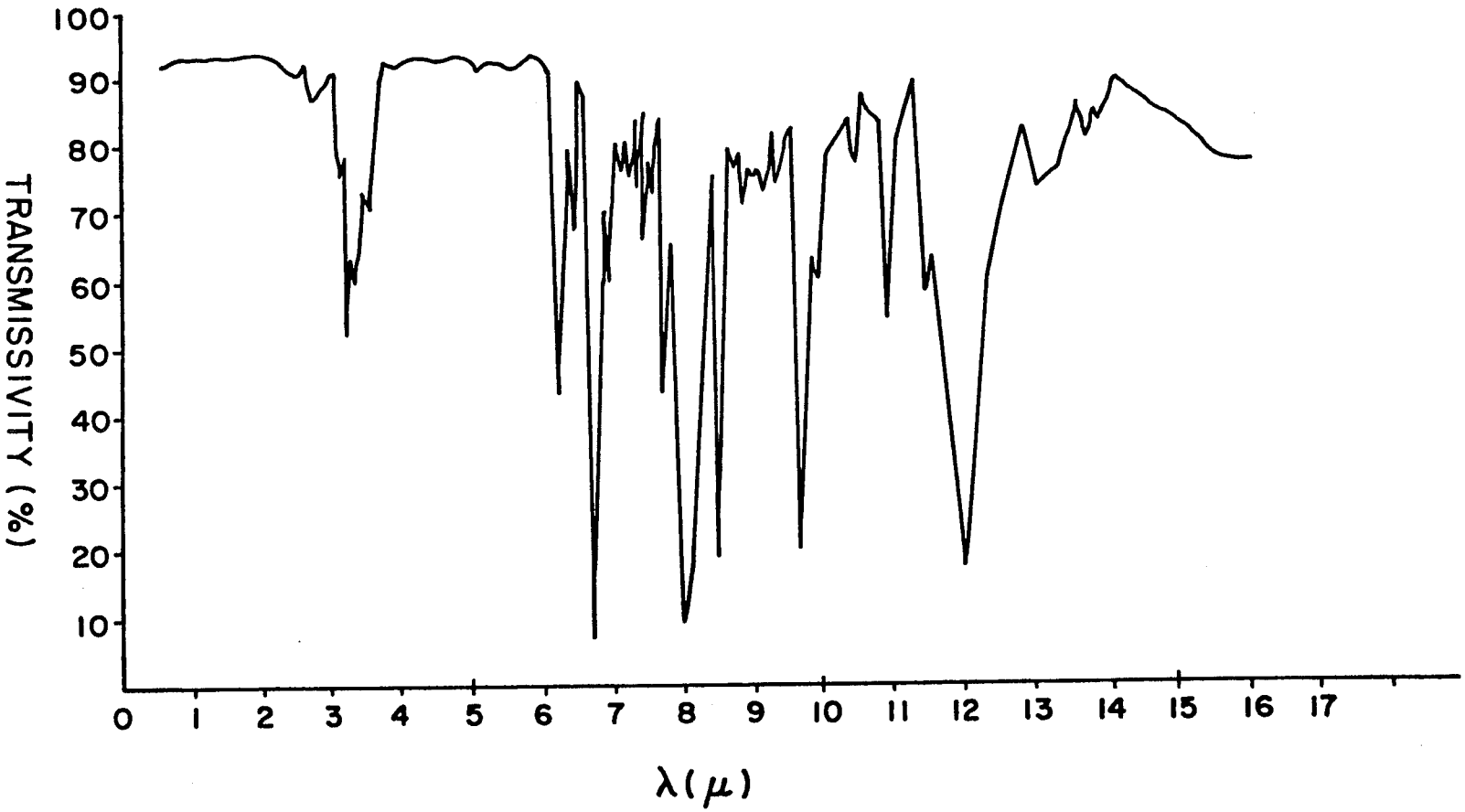
FIG. 2 is a characteristic curve showing an infrared spectrum of bisphenol A type epoxy resin.
Figure 3:
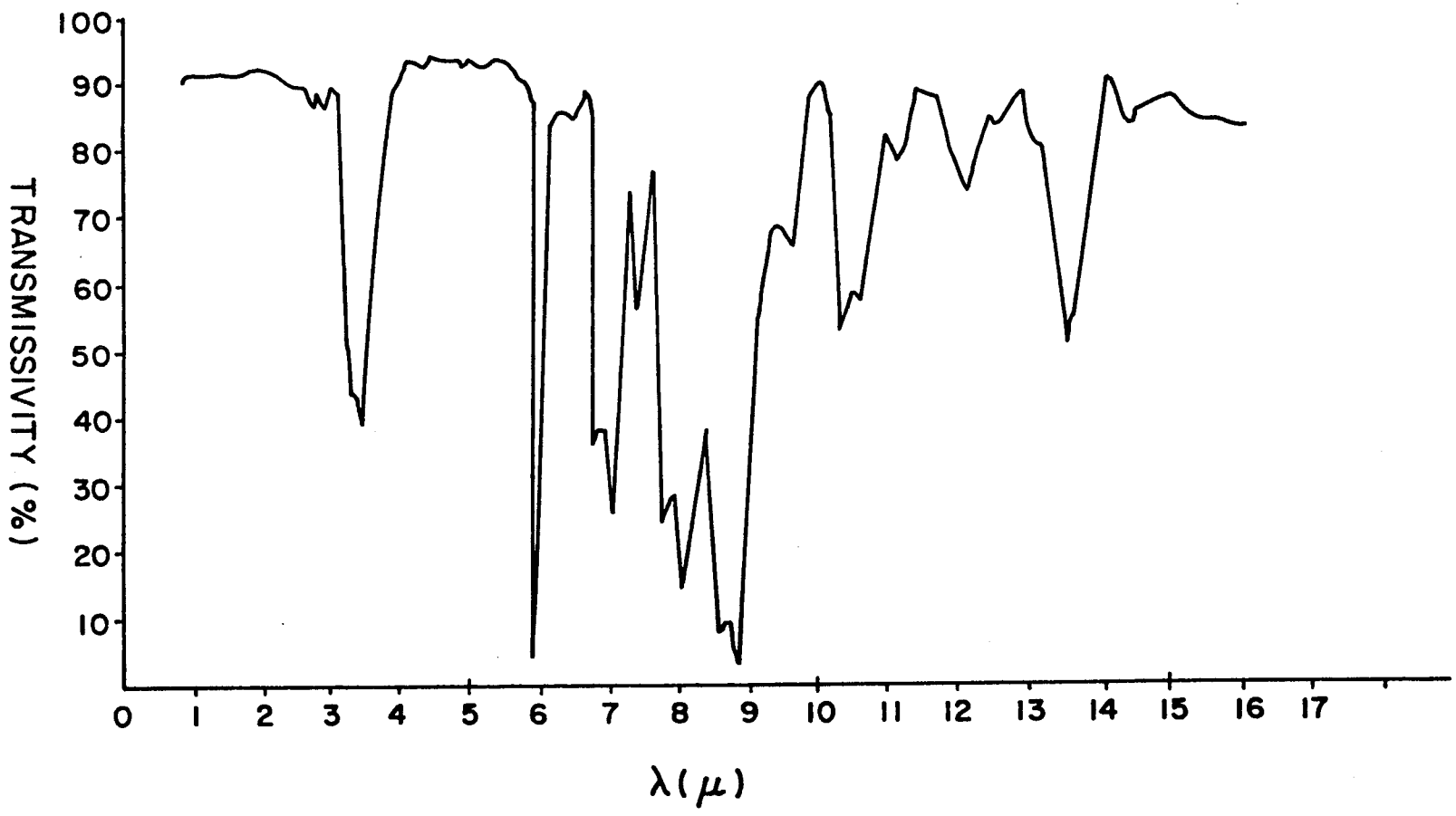
FIG. 3 is a characteristic curve showing an infrared spectrum of MMA homopolymer (acrylic group)
Figure 4:
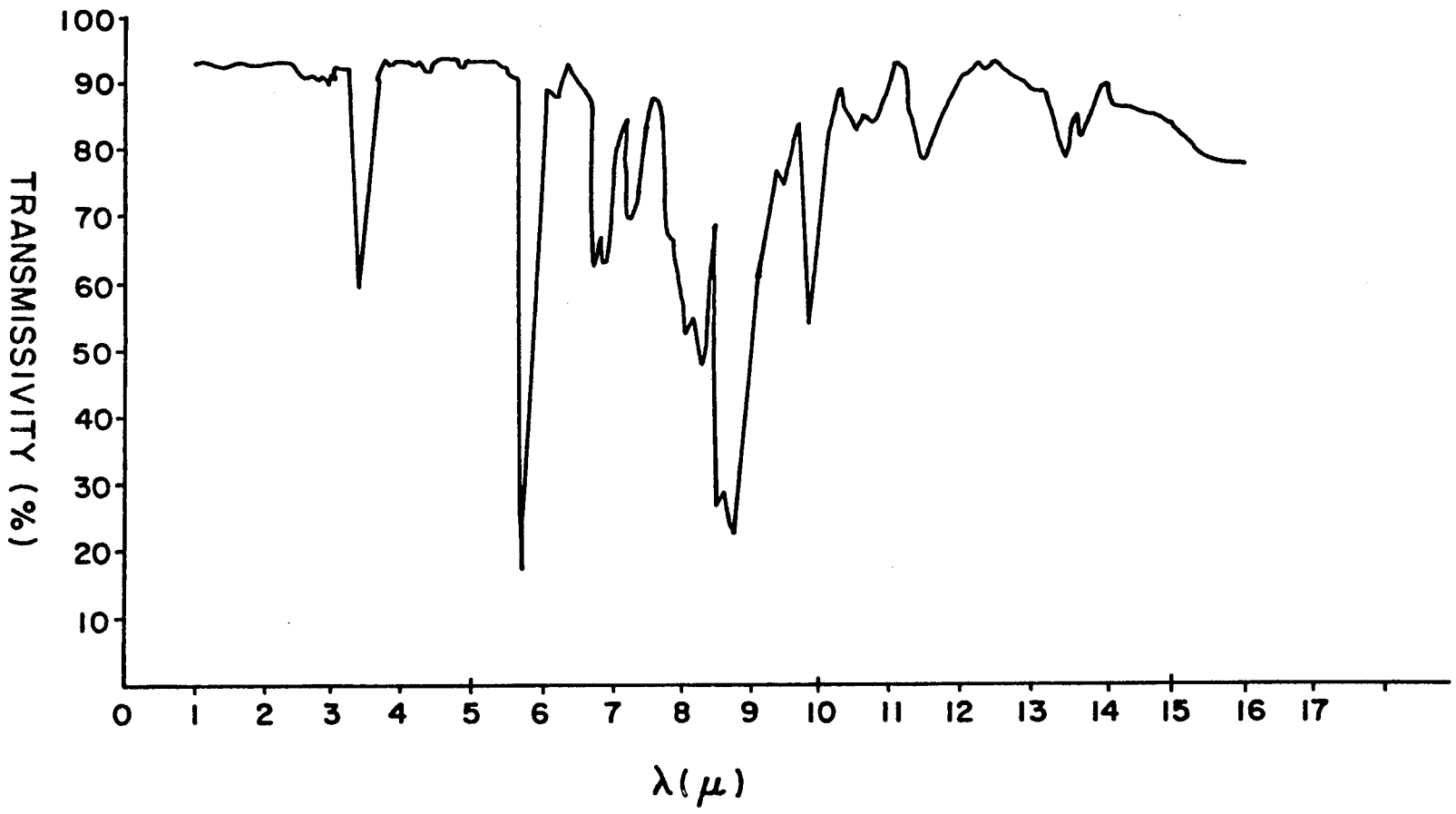
FIG. 4 is a characteristic curve showing an infrared spectrum of EMA homopolymer (acrylic group)
Figure 5:
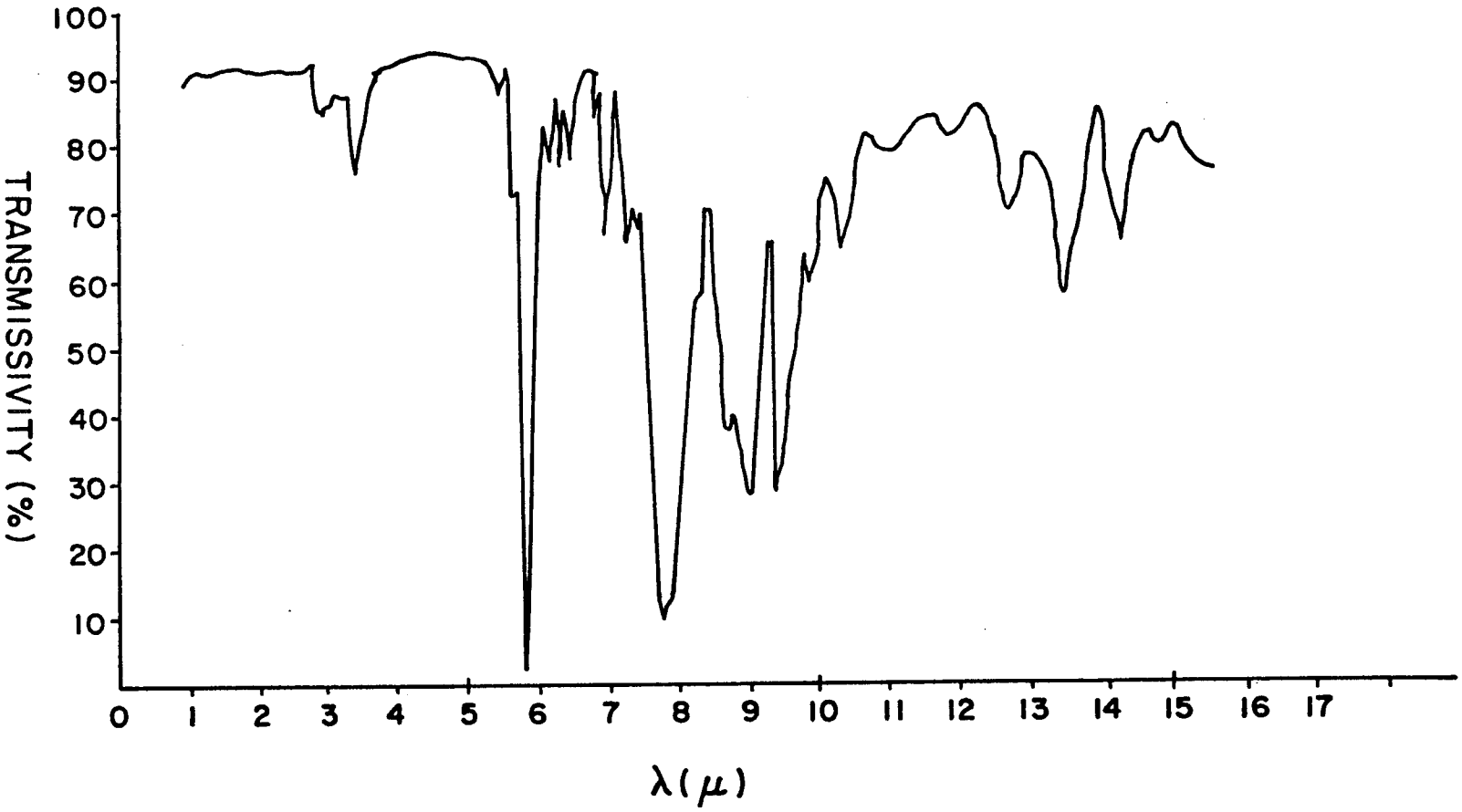
FIG. 5 is a characteristic curve showing an infrared spectrum of unsaturated polyester resin.
Figure 6:
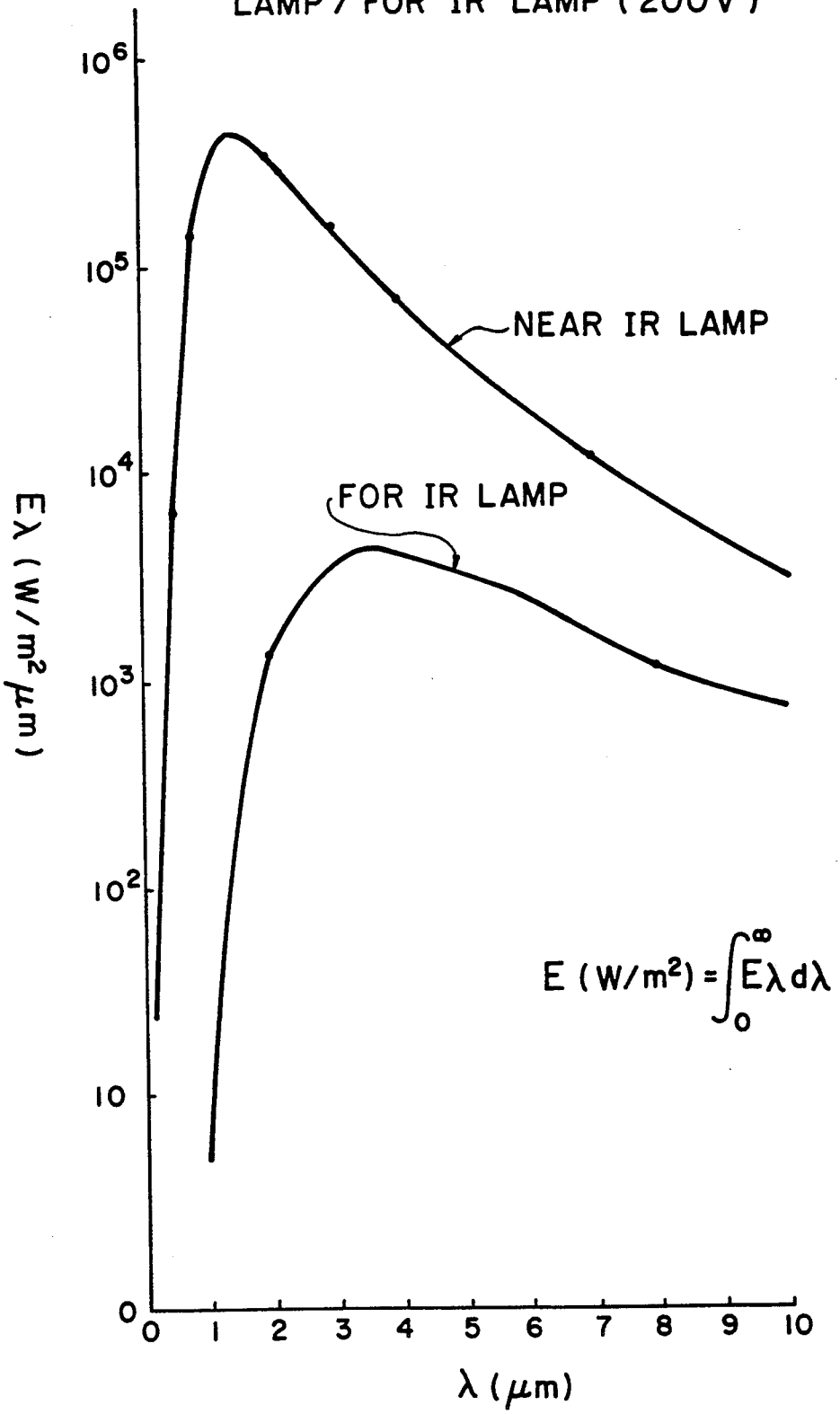
FIG. 6 is a graph showing characteristic curves of two different lamps for near infrared radiation and far infrared radiation.

FIG. 1 shows an infrared spectrum curve of butyl urea - butly melamine resin. FIG. 2 shows an infrared spectrum curve of bisphenol A type epoxy resin. FIG. 3 shows an infrared spectrum curve of MMA homopolymer (acrylic group). FIG. 4 shows an infrared spectrum curve of EMA homopolymer (acrylic group). FIG. 5 shows an infrared spectrum curve of unsaturated polyester resin. . FIG. 6 shows two characteristic curves of two different lamps for near infrared radiation used in this embodiment and far infrared radiation used in comparitive tests. The near infrared lamp has a peak at 1.4 μm and the far infrared lamp has a peak at 3.5 μm.

In a case that the work 100 is composed of one of the metals as described above and one of the coating materials as described above, the infrared lamp having a peak at 2 μm or less is preferably used, more preferably the near infrared lamp having a peak at 1.2 μm to 1.5 μm.

In the drying method according to the present invention, the work 100 is applied with the infrared radiation from the lamp having such characteristic. This range infrared radiation is easily transmitted through the coated layer and easily absorbed by the substrate, so that the radiated energy from the infrared lamp is almost absorbed by the substrate and changed into heating energy. Thus the coated layer is solidified from its rear surface facing the substrate by the heating energy. The solvent is the coating material is evaporated from the external surface of the coated layer which is not yet solidified. This drying function prevents the coated layer from generating pin holes or pores.

Hereinafter, a preferred embodiment 1 of the drying method according to the present invention will be described in detail referring to comparative examples 1 and 2.

EXAMPLE 1 ACCORDING TO EMBODIMENT 1

Light Source: near infrared lamp having a peak 1.4 μm.

Substrate: Bonderized steel plate (thickness 1 mm, dimension 100 mm × 100 mm)

Coating material: melamine resin (Amilac No. 1531 manufactured by Kansai Paint Co., Ltd., White, alkyd-melamine resin paint, viscosity 20 sec by Iwata Cup NK-2 viscometer)

COMPARATIVE EXAMPLE 1

Light Source: far infrared lamp having a peak at 3.5 μm.

Substrate: Bonderized steel plate (thickness 1 mm, dimension 100 mm × 100 mm)

Coating material: melamine resin (Amilac No. 1531 manufactured by Kansai Paint Co., Ltd., White, alkyd-melamine resin paint, viscosity 20 sec by Iwata Cup NK-2 viscometer)

EXAMPLE 2 ACCORDING TO EMBODIMENT 1

Light source: near infrared lamp having a peak at 1.4 μm.

Substrate: Bonderized steel plate (thickness 1 mm, dimension 100 mm × 100 mm)

Coating material: acrylic resin (Magicron No. 1531 manufactured by Kansai Paint Co., Ltd., White, acryl-melamine - epoxy resin paint, viscosity 20 sec by Iwata Cup NK-2 viscometer)

COMPARATIVE EXAMPLE 2

Light source: far infrared lamp having a peak at 3.5 μm.

Substrate: Bonderized steel plate (thickness 1 mm, dimension 100 mm × 100 mm)

Coating material: acrylic resin (Magicron No. 1531 manufactured by Kansai Paint Co., Ltd., White, acrylic-melamine - epoxy resin paint, viscosity 20 sec by Iwata Cup NK-2 viscometer)

Under the conditions described in Example 1, Comparative Example 1, Example 2, and Comparative Example 2, samples having three different coated layers whose thicknesses are 30 μm, 40 μm, and 50 μm were respectively subjected to six drying operations under the following drying temperature and radiating period; 130° C. × 12 min, 140° C. × min, 150° C. × 8 min, 160° C. × 6 min, 170° C. × 5 min, and 180° C. × 4 min. The samples were observed to count the number of pin holes generated in their surface. The counted number of the pin holes are shown in Tables 5 to 8.

Example 1 corresponds to Table 5, Comparative Example 1 corresponds to Table 6, Example 2 corresponds to Table 7, and comparative Example 2 corresponds to Table 8. According to these results, the samples having layer thickness 30 μm and 40 μm dried by the near infrared radiation having a peak at 1.4 μm do not generate pin holes at all regardless of the drying temperature and the radiating period. Further the samples having layer thickness 50 μm according to the drying method of the present invention do not generate pin holes when the drying temperature is 160° C. or less.

In a preferred embodiment 2 according to the present invention, the work 100 is subjected to a drying method employing a combination of the infrared radiation having the above described characteristic and a blow of hot air. The hot air is blown to the work 100 on the same occasion as the infrared radiation, or with a delay of the radiation. The irradiated area of the infrared radiation corresponds to the blowing area of hot air. The temperature of the hot air and the period for blowing it depend on kind of the coating material to be dried. Generally, the preferable temperature range is 150° C. to 200° C. In the drying method of this embodiment 2, the blow of hot air can keep the surface temperature of the work 100 at higher than a predetermined level, and the coated layer is heated and solidified from its rear surface by the infrared radiation. This heating effect can prevent the work 100 from generating temperature irregularity, so that the drying period can be shortened.

Figure 7:
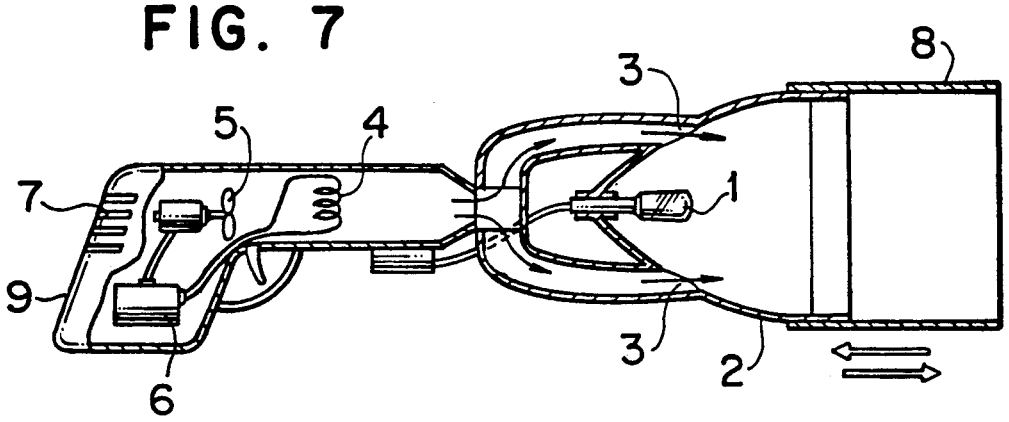
FIG. 7 is a longitudinal section showing a handy type drying device according to one embodiment "A1" of the invention.
Figure 8:
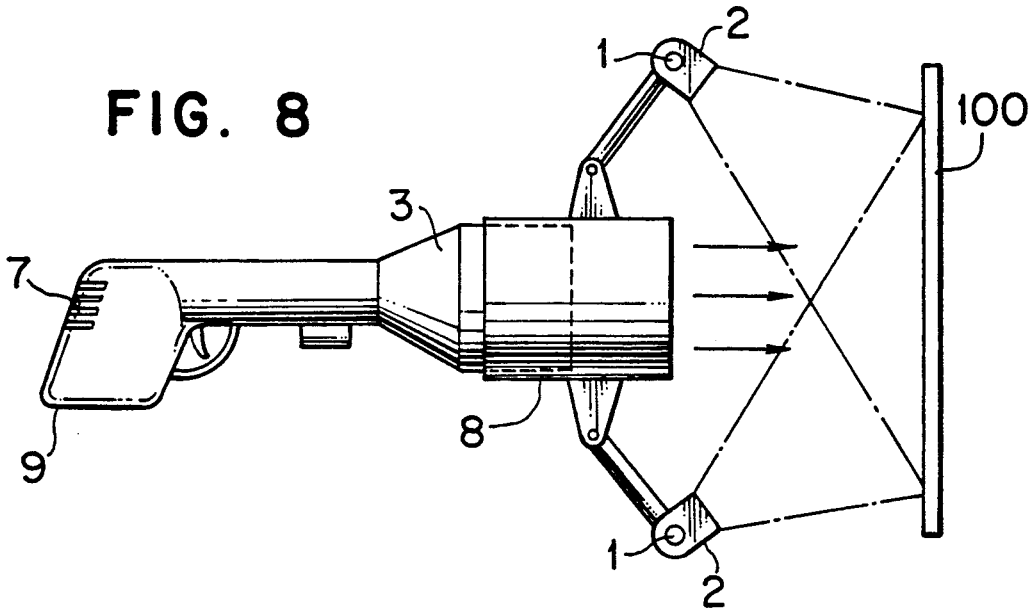
FIG. 8 is a schematical side view showing a modification "A2" of the drying device of the embodiment "A"

FIG. 7 to FIG. 12 show a handy type drying device according to one embodiment "A1" of the invention. This drying device employs a combination of infrared radiation and a blow of hot air. FIG. 7 is a longitudinal section showing a handy type drying device according to one embodiment "A1" of the invention and FIG. 8 is a schematical side view showing a modification "A2" of the drying device of the embodiment "A1".

In FIG. 7 and FIG. 8, the reference numeral 1 denotes an infrared (IR) lamp for generating near infrared radiation having a wave length characteristic curve with a peak at 2 μm or less, preferably 1.2 μm to 1.5 μm. The optimum infrared radiation for each work 100 is selected with reference to FIG. 1 to FIG. 6 and Table 1 to Table 8 so that the selected infrared radiation has a high transmissivity to the coated layer and a high absorptivity to the substrate.

Figure 10:
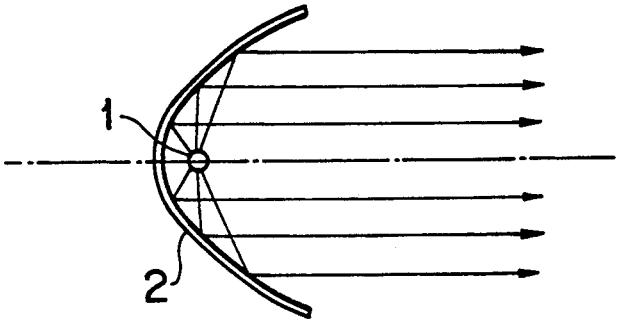
FIG. 10 is a partially enlarged section showing a parabolic reflector which is a component of the drying device shown in FIG. 7.
Figure 11:
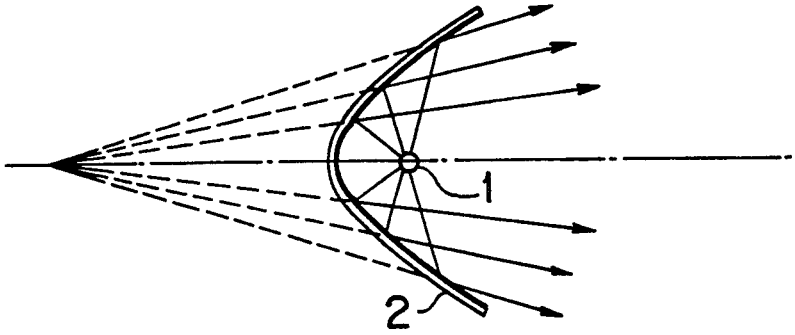
FIG. 11 is a partially enlarged section showing a hyperbolic reflector which is a component of the drying device shown in FIG. 7.

In FIG. 7, an infrared radiation device includes the IR lamp 1 and a reflector 2. As shown in FIG. 10 and FIG. 11, the IR lamp is set at the focus of the reflector 2. The reflector 2 shown in FIG. 10 is configured in a parabolic section form which reflects light beams in parallel with each other. The reflector 2 shown in FIG. 11 is configured in a hyperbolic section form which reflects light beam radially.

Figure 12:
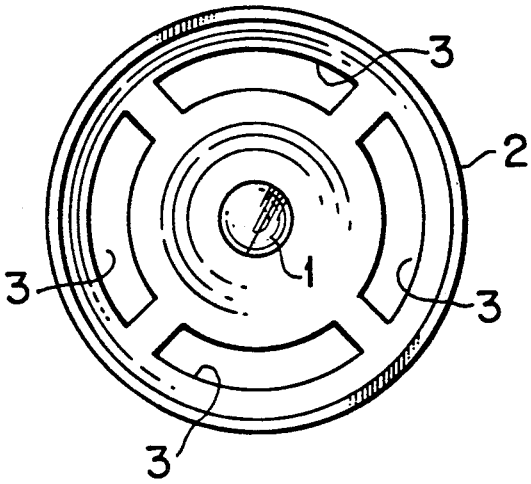
FIG. 12 is a schematic view showing the right side of the drying device shown in FIG. 7.

In FIG. 7, the reference numerals 3, 4, 5, 6 and 7 denote a hot air outlet port, a heater, a fan, a battery for the fan and an air inlet port, respectively. Furthermore, the reference numeral 8 denotes a telescopic hood which is slidably mounted on the reflector 2, and the numeral 9 denotes a handle. Ambient air is forcibly introduced through the air inlet port 7 by the rotation of the fan 5 and heated by the heater 4. The heated air is discharged into the telescopic hood through the hot air outlet port 3 which is,, for example, annularly formed around the reflector 2 as shown in FIG. 12. Thus the work 100 is applied with the heated air and the infrared radiation from the IR lamp 1 on the same occasion.

The modified device "A2" shown in FIG. 8 includes two sets of the IR lamp 1 and the reflector 2 which are arranged at the outside of the telescopic hood 8. Although FIG. 8 shows two sets of the IR lamp 1 and the reflector 2, more sets may be arranged as required.

Figure 9:
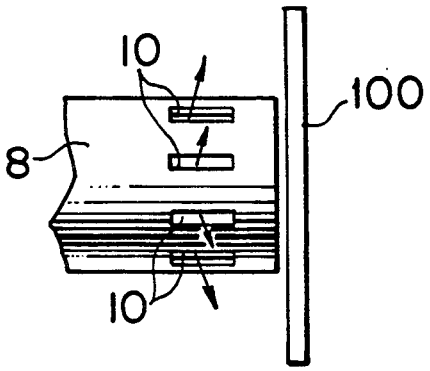
FIG. 9 is an enlarged schematic illustration showing a component of the drying device shown in FIG. 7.

FIG. 9 shows another modification "A3" of the drying device shown in FIG. 7, whose telescopic hood 8 is further provided near its front end with a plurality of slits 10 through which the heated air can be discharged. In practical use of this modified device "A3", the telescopic hood 8 is brought close to the work 100 as possible so that the heated air is stayed in the hood 8 for a long period to improve the efficiency of transmission of heating energy from the hated air to the work 100.

Comparative tests using the IR lamps with and without the reflector 2 for heating the work 100 up to 120° C. were carried out. The case without the reflector 2 required 7 min, while the situation where the reflector 2 was used required only 1 min 20 sec. The maximum temperature of the work 100 heated by the lamp with the reflector 2 was 1.65 times as large as the case without the reflector 2.

Table 9 represents the data of comparative test between the first heating device using only a blow of hot air and the second heating device using a combination of hot air and infrared radiation as shown in the embodiment "A1" according to the present invention, wherein two sample materials. Bonderized steel plates are heated by these two heating devices and respective temperatures of the samples per unit time are measured. This comparative test provides the result that the second heating device; i.e., the combination of hot air and infrared radiation, is superior to the first heating device.

When the work 100 composed of melamine resin layer formed on the Bonderized steel plate was subjected to the same comparative test as the above, the second heating device; the embodiment "A1", provided superior results such that the coated layer can be effectively dried and the drying period can be remarkably shortened in comparison with the first heating device.

Table 10 represents the data of comparative test between the handy type drying device "A1" shown in FIG. 7 and a conventional drying furnace using only a blow of hot air, wherein respective coating materials were heated to reach a pre-determined standard hardness and their heating temperatures and periods were measured.

FIG. 13 to FIG. 17 are drawings relating to another drying device according to an embodiment "B" of the present invention, which uses a combination of hot air and infrared radiation. The hot air is blown toward the work 100 from the back of the light source for infrared radiation.

Figure 13:
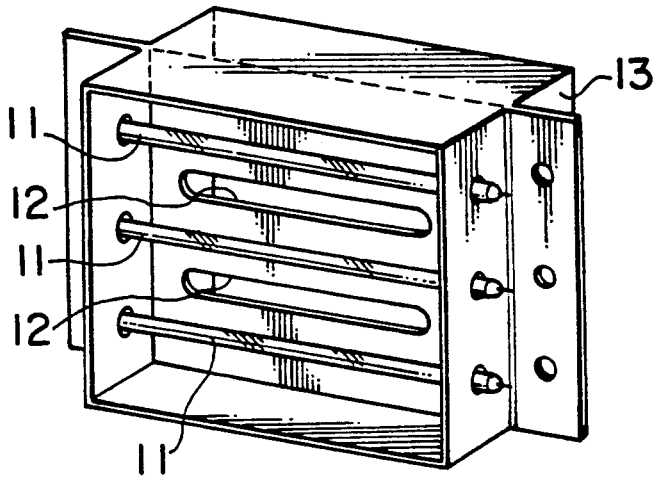
FIG. 13 is a perspective illustration showing a drying device according to another embodiment "B" of the present invention.
Figure 14:
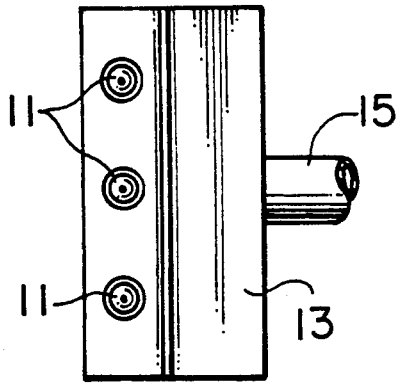
FIG. 14 is a schematic view showing the right side view of the drying device shown in FIG. 13.
Figure 15:
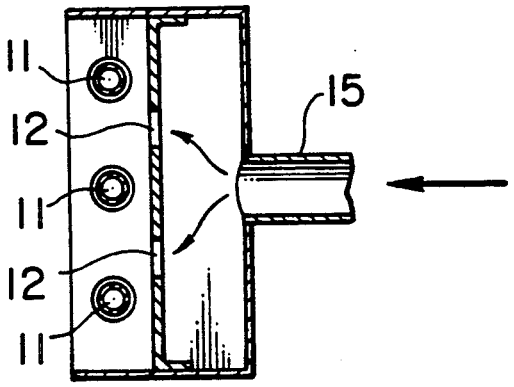
FIG. 15 is a cross sectional view showing the drying device shown in FIG. 13.
Figure 16:
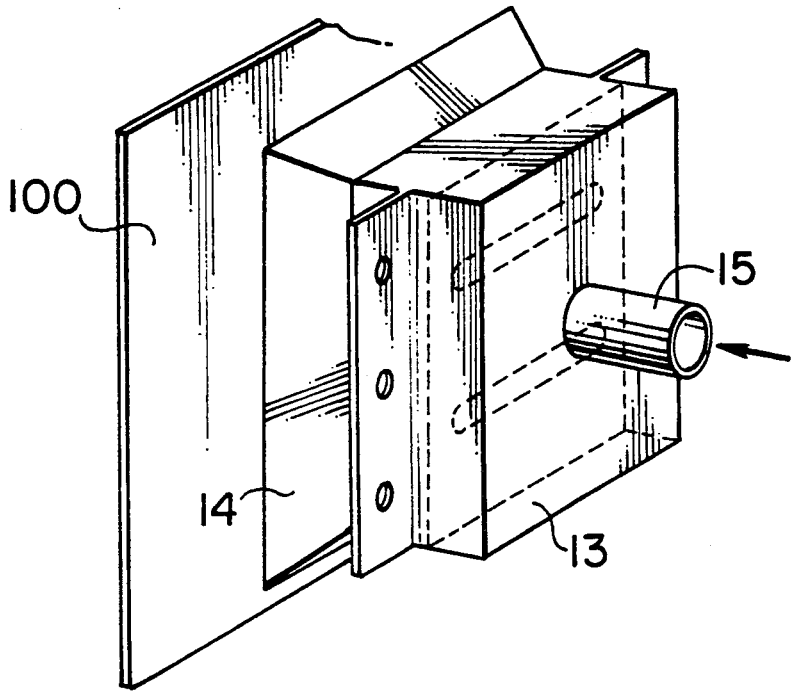
FIG. 16 is a perspective illustration showing the rear side of the drying device shown in FIG. 13.
Figure 17:
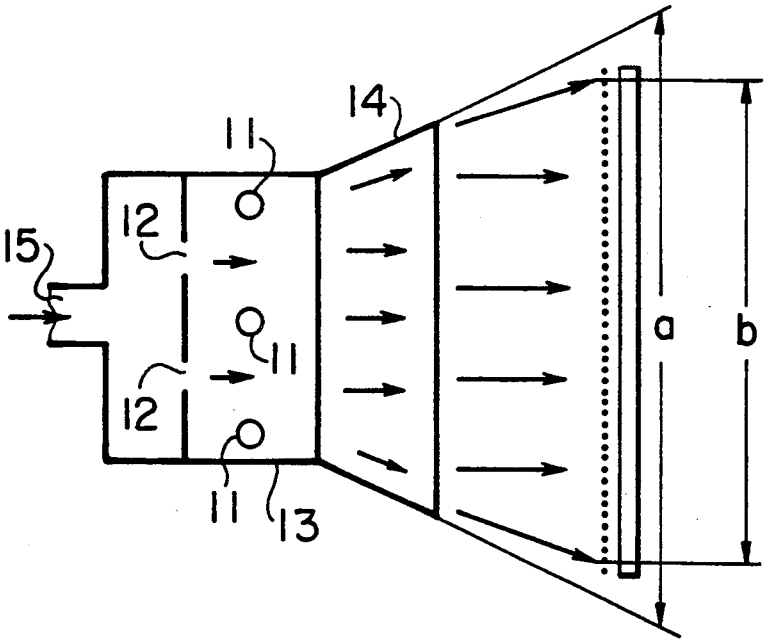
FIG. 17 is a schematic illustration for explaining the operation of the drying device shown in FIG. 13.

FIG. 13 is a perspective view of the drying device "B". FIG. 14 shows the right side thereof. FIG. 15 is a schematic sectional view of the FIG. 14, and FIG. 16 is a perspective view showing the rear side of the FIG. 13. Further, FIG. 17 shows an operation state of the same. The drying device "B" comprises a plurality of IR lamps 11 for generating near infrared radiation whose wave length having a peak at 2 μm or less, preferably 1.2 μm to 1.5 μm in the case that the work 100 is composed of a substrate selected from iron, aluminium, copper, brass, gold, beryllium, molybdenum, nickel, lead, rhodium, silver, tantalum, antimony, cadmium, chromium, iridium, cobalt, magnesium, tungsten, and so on and a coating material selected from acrylic resin paint, urethane resin paint, epoxy resin paint, melamine resin paint, and fluoro resin paint. The distance between the front surface of the IR lamp 11 and the work surface is about 250 mm to 300 mm.

The device "B" further includes hot air blowing slits 12 and a housing 13 in which three IR lamps 11 are arranged in parallel with each other in this embodiment. Each of the slits 12 is arranged between two lamps 11. Further, a plurality of slits may be arranged at right angles to the lamps 11 so that the air blowing rate will be increased.

As shown in FIG. 16, the device "B" is provided with a hood 14 mounted on the front end of the housing 13, and an air pipe 15 through which hot air is supplied.

The device "B" is operated as follows.

The IR lamps 11 generate near infrared radiation having characteristic with a high transmissivity to the coating material coated on the substrate and a high absorptivity to the substrate. ,The work 100 is subjected to the infrared radiation from the lamps 11 and blow of hot air from the slits 12. The blowing area "b" of hot air is within the radiated area "a" of the infrared radiation as shown in FIG. 17. Accordingly, if the work 100 is set within the blowing area "b", the surface temperature of the work is kept at least a predetermined level. The infrared radiation transmitted through the coated layer is absorbed by the substrate and changed to heating energy to heat the rear surface of the coated layer. The solidification of the coated layer gradually progresses from the rear surface so that the solvent of the coating material can be evaporated before the surface solidification is formed. Thus the work surface can be prevented from generating pin holes and pores.

The drying device "B" may be installed in a furnace such as a tunnel shape furnace in order to decrease energy loss and improve in deodorization of the drying process.

FIGS. 18 to 22 are drawings relating to a drying device according to a further embodiment "C" of the present invention. This device "C" uses a combination of infrared radiation and hot air blowing in a direction at right angles to the radiating direction.

Figure 18:
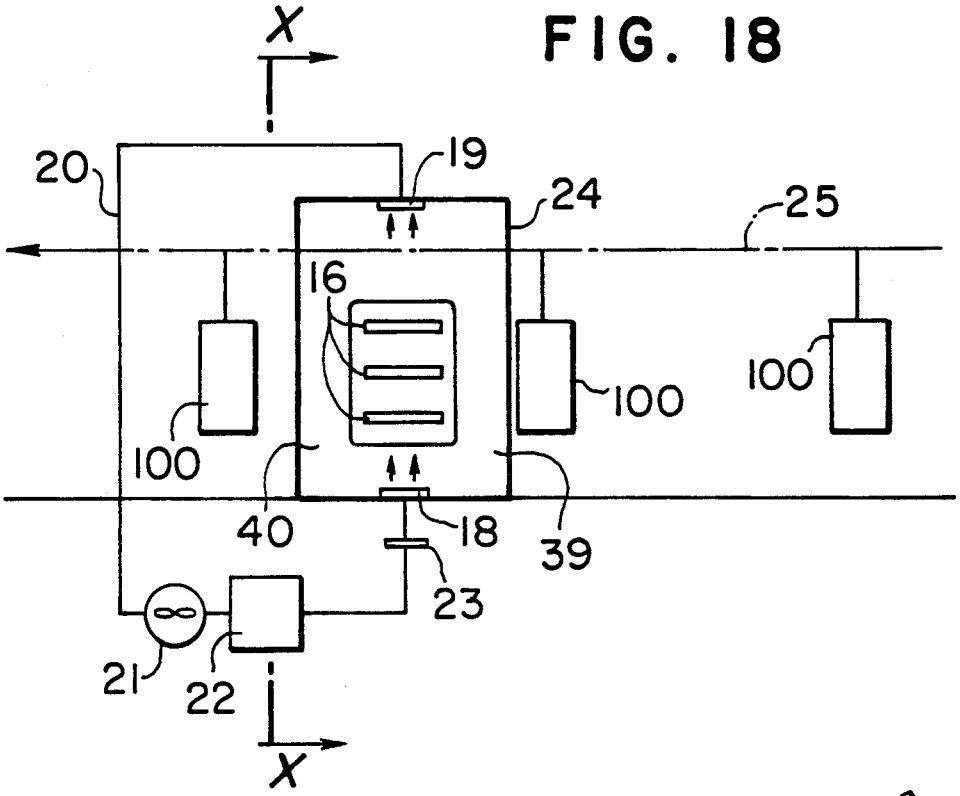
FIG. 18 is a schematic cross sectional view showing a drying device according to a further embodiment "C" of the present invention.
Figure 19:
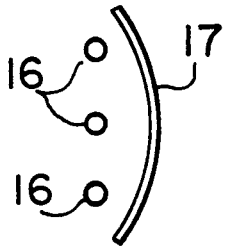
FIG. 19 is an enlarged schematic view showing a light source for infrared radiation used in the drying device shown in FIG. 18.
Figure 20:
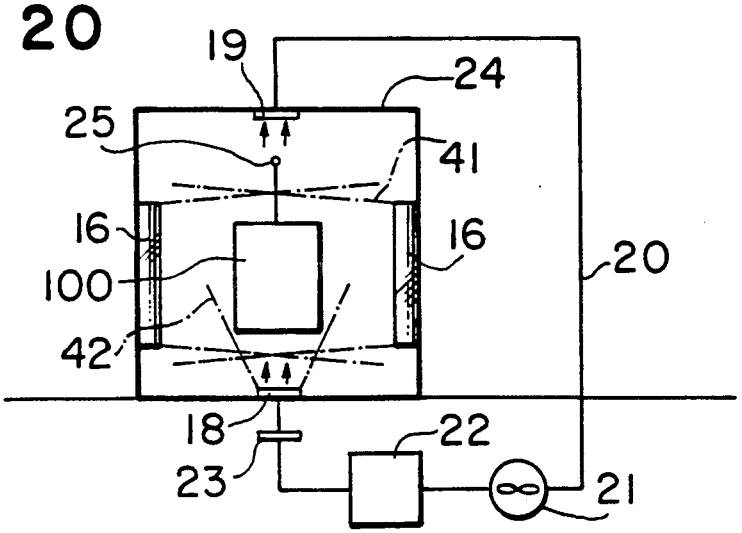
FIG. 20 is a sectional view taken along the line X — X in FIG. 18.
Figure 21:
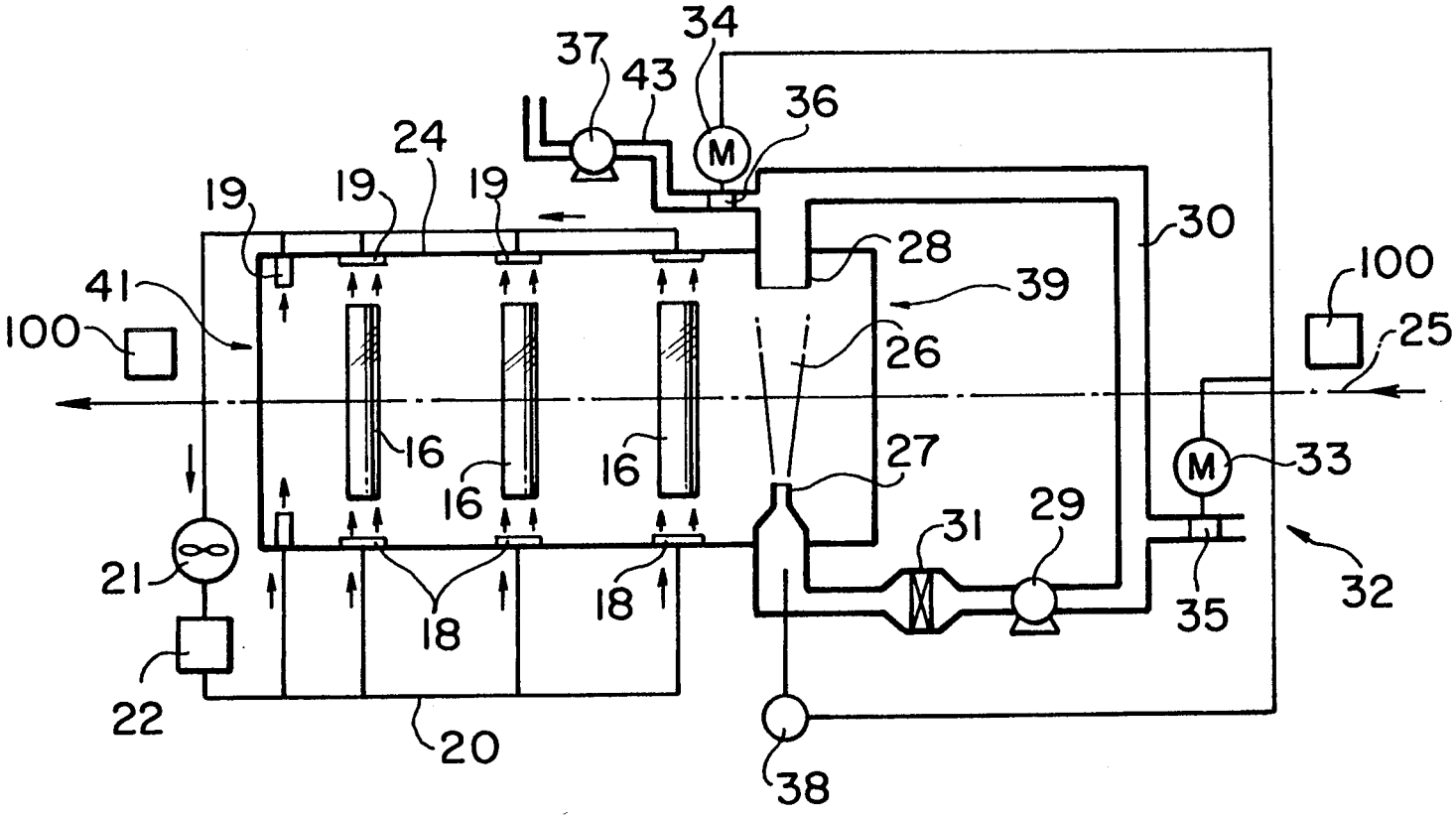
FIG. 21 is a schematic cross sectional view showing a modification of the drying device shown in FIG. 18.
Figure 22:
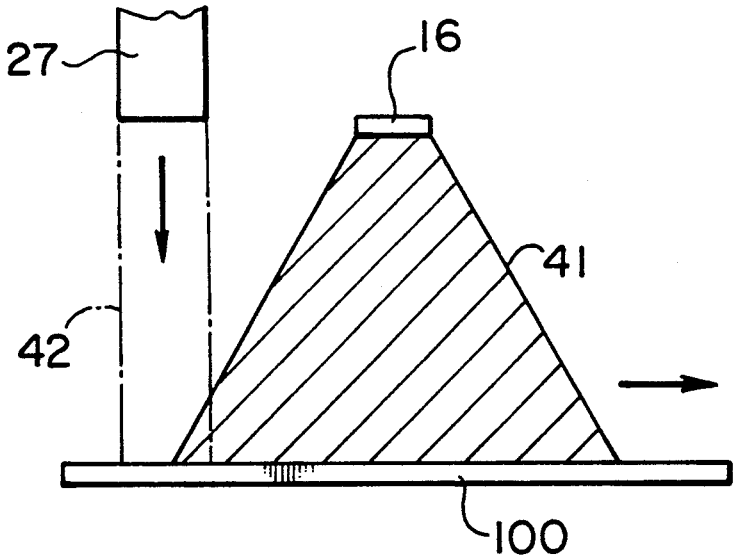
FIG. 22 is a partially enlarged illustration showing one component of the modified drying device shown in FIG. 21.

FIG. 18 shows a cross section of this device "C". FIG. 19 shows an enlarged view of an IR light source. FIG. 20 shows a sectional view taken along the line X—X in FIG. 18. FIG. 21 shows a cross section of a modified drying device "C2". FIG. 22 shows a partially enlarged view of the device "C2" shown in FIG. 21.

The drying device and the modified device comprise IR

16 for generating infrared radiation having the same characteristic as the before mentioned embodiments. The work 100 is composed of the same substrate and the same coating material as shown in the above embodiment "B". The distance between the IR lamps 16 and the work 100 is the same as the above embodiment "B".

Referring to FIG. 19, the IR lamps 16 are arranged in parallel with each other in front of a reflector 17. A pair of banks including the IR lamps 16 are oppositely arranged at side walls of a tunnel furnace 24 so as to interpose the work 100 between the banks. Although this embodiment employs a pair of banks, two or more banks maybe arranged. The work 100 is transported into the tunnel furnace 24 through an inlet opening 39 and out of the furnace 24 through an outlet opening 40.

The drying device further includes a lower port 18 formed in the bottom wall of the tunnel furnace 24 and an upper port 19 formed in the ceiling wall of the tunnel furnace 24. The lower port 18 and the upper port 19 are oppositely arranged and communicated with each other through a circulation duct 20. The duct 20 includes a fan 21 for forcibly circulating air from the upper port 19 to the lower port 18, and a heating unit 22 for heating the circulating air. The heating unit 22 is not limited to an electric heating device, but any commonly used heating means also may be used. The duct 20 further includes a filter 23 for removing dust flowing in the circulating air.

The work 100 is transported by a conveyer 25 which can move through the tunnel type furnace 24.

A typical operation of the drying device "C" is described as follows.

The IR lamps 16 generate near infrared radiation having characteristic with a high transmissivity to the coating material coated on the a substrate and high absorptivity to the substrate. The work 100 is subjected to the infrared radiation from the lamps 16 and blow off hot air from the lower port 18. The hot air is blown at right angles with respect to the radiated direction of infrared radiation along the moving direction of the work 100 so that the work 100 can be transported through the cross area defined by the radiation 41 and the blow 42. Accordingly, the surface temperature of the work 100 is equal to or greater than a predetermined level by passing through the cross area. The hot air is introduced into the upper port 19 and circulated through the circulation duct 20 at the same time that the circulating air is heated. The heated air is then blown from the lower port again.

If the work is heated by near infrared radiation without a blow of hot air, the surface temperature of the work will sometimes rise irregularly. The combination of the infrared radiation and the blow of hot air ensures a uniform temperature over the work surface.

The hot air is blown on the work at the same time or subsequent to the application of the IR radiation. If the hot air is blown before the radiation, the solidification will start from the work surface. Then the solvent in the coating material will be evaporated by the heating energy of infrared radiation so that the evaporated solvent will make pin holes in the work surface.

In the drying device "C", the infrared radiation from the IR lamps 16, is transmitted through the coated layer of the work 100. On the same occasion, the work 100 is subjected to the hot air blown from the lower port 18. The blowing area 42 is within the radiated area 41. The transmitted IR is absorbed by the substrate and changed to heating energy to heat the rear surface of the coated layer. The solidification of the coated layer gradually progresses from the rear surface so that the solvent of the coating material can be evaporated before the surface solidification is formed. Thus the work surface can be prevented from generating pin holes and pores.

Referring to FIG. 21 and FIG. 22, there is shown the modified drying device "C2" which is further provided with an air curtain in addition to the device "C" shown in FIGS. 18 to 20. Since the some numerals denote the same or corresponding members, the same explanation is not repeated.

The work 100 is transported into a tunnel type furnace 24 through an inlet opening 39 and out of the furnace 24 through an outlet opening 40. The furnace 24 includes IR lamps 16 having the same characteristic as the before mentioned embodiments.

The furnace 24 is further provided with an air curtain 26 which is generally formed at the inlet opening 39 or may be formed at the outlet opening 40 as required. The air curtain 26 is formed between an air blowing port 27 from which air is blown and an air vent 28 through which air is introduced into a circulation duct 30 communicated between the air blowing port 27 and the air vent 28. The duct 30 includes a fan 29 and a filter 31 arranged at the downstream of the fan 29.

Air is forcibly circulated from the air vent 28 to the air blowing port 27 by the fan 29 to blow upwardly from the port 27.

FIG. 22 shows an effective radiated area 41 of the IR lamp 16. The air curtain 26 formed area 42 may partially interfere with the effective radiated area 41.

Returning to FIG. 21, the drying device "C2" further includes two modular-stroll motors 33,34 and two dampers 35,36. The damper 35 is arranged at the upperstream of the fan 29 of the circulation duct 30, and actuated by the motor 33. The damper 36 is arranged at the downstream of the air vent 28, and actuated by the motor 34. The damper 36 is communicated with an exhaust duct 43 in which an exhaust fan 37 is interposed. The circulation duct 30 further includes a temperature controller 38 arranged near the air blowing port 27, which can sense the temperature of blowing air and control the motors 33 and 34. These elements will function as a cooling system 32 to maintain the temperature of the blowing air at the same level.

A typical operation of the drying device "C2" is described as follows.

The work 100 is transported into the tunnel type furnace 24 through the inlet opening 39. When the work 100 passes through the air curtain 26, it is subjected to the blow of air from the air blowing port 27. Since the temperature of this air curtain 26 is always maintained at a predetermined level owing to the cooling system 32, the work surface is not solidified by the air curtain 26.

The cooling system 32 operates as follows. For example, when the inner temperature of the tunnel type furnace 24 is 160° C. and the predetermined temperature of the blowing air from the port 27 is 80° C., the temperature controller 38 detects the actual temperature 110° C. of the blowing air from the port 27 and actuates the motors 33 and 34 to correct the difference temperature 30° C. between the actual temperature and the predetermined temperature. The motor 33 drives the damper 35 to open so that ambient air is introduced into the circulation duct 30. The motor 34 also drives the damper 36 to open and the exhaust fan 37 to rotate so that the air is forcibly exhausted out of the circulation duct 30 through the exhaust duct 43 When the temperature controller 38 detects that the actual temperature of the blowing air from the port 27 has returned to the predetermined temperature level, the dampers 35 and 36 are fixed at their opening angles to keep the temperature of air curtain 26 at the predetermined level.

On the other hand, when the work is dried by the drying device employing IR lamps having the same characteristic as the above described embodiments and a tunnel type furnace with a conventional air curtain whose air is simply circulated without any temperature control, many pin holes are generated in the work surface. This phenomenon occurs because the drying furnace employing the IR lamps having the same characteristic as the above described embodiments has improved heating efficiency, and such heating energy is easily radiated from the furnace. The air curtain is heated by this radiated heat, so that the air temperature of the air curtain is extremely increased. The work surface is subjected to this heated air when the work 100 passes through the air curtain. After the work surface is solidified, the work 100 is subjected to the infrared radiation from the IR lamps to heat the substrate. Then the solvent in the coating layer is evaporated through the solidified surface, thereby generating many pin holes in the work surface.

In the outside of the radiation area 41 of IR lamp, the work 100 should be free from such heated air.

Since the drying device "C2" can always control the air temperature of the air curtain 26 at the predetermined level, the work 100 is not heated prior to the infrared radiation from the IR lamps 16. In the tunnel type furnace 24, the infrared radiation from the IR lamps 16 is applied to the work 100. On the same occasion, the work 100 is subjected to the hot air blown from the lower port 18 in the same manner as the device "C" shown in FIG. 18 to FIG. 20. The blowing area 42 is within the radiated area 41. The IR energy transmitted through the coated layer is absorbed by the substrate and changed to heating energy to heat the rear surface of the coated layer. The solidification of the coated layer gradually progresses from the rear surface so that the solvent of the coating material can be evaporated before the surface solidification is formed. Thus, the work surface can be prevented from generating pin holes and pores.

Table 11 shows the result of experimental test on the generation of pin holes in the work surface using the drying furnace "C2" shown in FIG. 21, wherein air velocity and air, temperature of the air curtain are varied. According to this result, the air temperature of the air curtain is preferably kept at 80° C. or less in order to prevent the work surface from generating pin holes.

This experimental test was carried out under the following conditions.

Coating Material: Melamine resin
Substrate: Bonderized steel plate 1.2 t
Layer Thickness: 30 μm
Room Temp.: 30° C.
Furnace Temp.: 160° C.
Height of Air Curtain (distance between the air blowing port and the air vent): 2 m
Air Velocity of Air Curtain (relation of the velocity at air vent to the velocity at air blowing port): 4 m/s to 10 m/s, 2.8 m/s to 7 m/s, 1.2 m/s to 4 m/s Practically, the drying furnace "C2" uses the combination of the IR lamps for near infrared radiation, the blow of hot air and the air curtain whose air temperature is controlled at the predetermined level in order to completely prevent the work surface from generating pin holes and pores.

In the before mentioned embodiments "A", "B" and "C", the work 100 is subjected to the hot air maintained at 130° C. or more, preferably 150° C. or more at velocity of at least 1.0 m/s, preferably at least 2.0 m/s when the coating material is selected from melamine type resins; 100° C. or more, preferably 170° C. or more at velocity of at least 1.0 m/s, preferably at least 2.0 m/s when the coating material is selected from acrylic resins. These temperature and velocity conditions depend on the distance between the IR lamps 1, 11 or 16 and the work 100.

Table 12 shows the result of comparative experimental test on hardening efficiency of the coated layer (thermosetting resin) by the conventional furnace using only hot air and the embodiments "B" and "C". The hardening efficiency is represented by the period required to their standard hardnesses.

This experimental test was carried out under the following conditions.

1. Viscosity of Coating Material: 16 to 18 sec
2. Layer Thickness: 20 μm(± 2)
3. Hardness Measurement: Pencil Hardness The temperature conditions of the conventional furnace and the drying devices "B" and "C" correspond to the air temperature in the furnace, and the air temperature near the work surface, respectively. According to this result, the hardening period required to the standard hardness of the coating material in the embodiments "B" and "C" were shortened as follows rather than the conventional case.

1. Melamine Resin: 1/10
2. Acrylic Resin: 1/18
3. Polyester Resin: about 1/4.4
4. Fluoro Resin: about 1/3.6

These experimental tests provided various evidences representing that the drying devices according to the present invention are superior to the conventional devices.

Table 13 shows the result of comparative experimental test on the relation among drying temperature, drying time and hardness of the dried layer of Acrylic resin by the conventional furnace using only hot air and the drying devices "B" and "C" using the combination of the IR lamps for near infrared radiation and the blow of hot air. The experimental test in the drying devices "B" and "C" was carried out under the temperature condition of 110° C. and 170° C.

According to Table 13, the drying time required in the drying devices "B" and "C" could be shortened as follows in comparison with the conventional furnace.

(A) Re; Hardness value "H" as a standard hardness
1. Under the hot air at 110° C.: about 1/4.6
2. Under the hot air at 170° C.: about 1/7

(B) Re; Hardness value "2H" as a standard hardness
1. Under the hot air at 110° C.: about 1/4.5
2. Under the hot air at 170° C.: about 1/9

As is clear from the above described experimental results, the hardening speed of the coated layer by the drying device using the combination of the IR lamps for near infrared radiation and the blow of hot air is remarkably faster than the conventional drying device (furnace) using only the IR lamps for near infrared radiation. In addition to this effect, the hardening speed is more faster as the temperature of hot air rises.

The temperatures 110° C. and 170° C. in Table 13 correspond to the air temperature near the work surface.

Next, an experimental test on hardening efficiency of the coated layer (melamine resin and acrylic resin) by the drying devices "B" and "C" in which the hot air blowing is only available was carried out.

Experimental conditions are as follows.

1. Sample substitute: Bonderized steel plate (thickness 0.8 mm, dimension 600 × 700 mm.)
2. Velocity of Hot Air: 2.0 m/sec
3. Viscosity of Coating Material: 18 to 19 sec/NK-2 (viscometer)

After 9 min, the coated layers were hardened "B" or less which are not available in practical uses.

Finally, Table 14 shows various data of the devices and materials used in the above described experimental tests, and the test conditions.

As many apparently widely different embodiments of this invention may be made without departing from the spirit and scope thereof, it is to be understood that the invention is not limited to the specific embodiments thereof except as defined in the appended claims.

TABLE 1

| Wave Length | Reflectance of Metals | | | | |
|---|---|---|---|---|---|
| (μm) | Au | Be | Cu | Mo | Ni |
| 0.25 | — | 56 | 25.9 | — | 47.5 |
| 0.30 | — | 50 | 25.3 | — | 41.5 |
| 0.35 | — | — | 27.5 | — | 45.0 |
| 0.40 | 36.0 | 48 | 30.0 | 44.0 | 53.3 |
| 0.50 | 41.5 | 46 | 43.7 | 45.5 | 59.7 |
| 0.60 | 87.0 | — | 71.8 | 47.6 | 64.5 |
| 0.70 | 93.0 | — | 83.1 | 49.8 | 67.6 |
| 0.80 | — | 50 | 88.6 | 52.3 | — |
| 1.0 | — | 54.5 | 90.1 | 58.2 | 74.1 |
| 2.0 | — | — | 95.5 | 81.6 | 84.4 |
| 4.0 | — | — | 97.3 | 90.5 | — |
| 6.0 | — | — | 98.0 | 93.0 | — |
| 8.0 | — | — | 98.3 | 93.7 | 96.0 |
| 10.0 | — | — | 98.4 | 94.5 | — |
| 12.0 | — | — | 98.4 | 95.2 | — |

TABLE 2

| Wave Length (μm) | Reflectance of Metals Pd | Rh | Ag | Ta |
|---|---|---|---|---|
| 0.25 | — | — | 25 | — |
| 0.30 | — | — | 13 | — |
| 0.35 | — | — | 68 | — |
| 0.40 | — | — | 87.5 | — |
| 0.50 | — | 76 | 95.2 | 38.0 |
| 0.60 | — | — | — | 45.0 |
| 0.70 | — | 79 | 96.1 | 56.0 |
| 0.80 | — | 81 | 96.2 | 64.5 |
| 1.0 | 74.8 | 84 | 96.4 | 78.5 |
| 2.0 | — | 91 | 97.3 | 90.5 |
| 4.0 | 88.1 | 92.5 | 97.7 | 93.0 |
| 6.0 | — | 93.5 | 98.0 | 93.2 |
| 8.0 | 94.7 | 94 | 98.7 | 93.8 |
| 10.0 | 96.5 | 95 | 98.9 | 94.5 |
| 12.0 | 96.5 | — | 98.9 | 95.0 |

TABLE 3

| Wave Length (μm) | Reflectance of Metals Al | Sb | Cd | Cr | Fe |
|---|---|---|---|---|---|
| 0.6 | — | 53 | — | 55.6 | 57.5 |
| 1.0 | 73.3 | 55 | 71.0 | 57.0 | 65.0 |
| 2.0 | 82.0 | 60 | — | 63.0 | 78.0 |
| 3.0 | 88.3 | 65 | 93 | 70.0 | 84.5 |
| 4.0 | 91.4 | 68 | — | 76.0 | 89.5 |
| 5.0 | 93.7 | — | 95.9 | 81.0 | 91.5 |
| 6.0 | — | 70 | — | 85.0 | 93.0 |
| 7.0 | 95.0 | — | — | — | 94.0 |
| 8.0 | 96.9 | — | 97.2 | 89.0 | 94.0 |
| 9.0 | — | 72 | 98.0 | 92.0 | 94.0 |
| 10.0 | 97.0 | — | 98.0 | 93.0 | — |
| 12.0 | 97.3 | — | 98.2 | — | — |

TABLE 4

| Wave Length (μm) | Reflectance of Metals Ir | Co | Mg | W |
|---|---|---|---|---|
| 0.6 | — | — | — | 53.1 |
| 1.0 | 79.4 | 67.6 | 74.0 | 57.6 |
| 2.0 | — | — | 77.0 | 90.0 |
| 3.0 | 91.4 | 76.7 | 80.5 | 94.3 |
| 4.0 | 93.3 | 80.7 | 83.5 | 94.8 |
| 5.0 | 94.0 | 86.0 | 86.0 | 95.3 |
| 6.0 | 94.5 | — | 88.0 | 95.8 |
| 7.0 | 94.7 | 98.0 | 91.0 | — |
| 8.0 | 94.8 | 95.8 | 93.0 | — |
| 9.0 | 95.5 | 96.4 | 93.0 | — |
| 10.0 | 95.8 | 96.8 | — | — |
| 12.0 | 96.1 | 96.6 | — | — |

TABLE 5

| Drying Condition | Counted Number of Pin Holes, Layer Thickness 30 μm | 40 μm | 50 μm |
|---|---|---|---|
| 130° C. × 12 min | 0 | 0 | 0 |
| 140° C. × 10 min | 0 | 0 | 0 |
| 150° C. × 8 min | 0 | 0 | 0 |
| 160° C. × 6 min | 0 | 0 | 0 |
| 170° C. × 5 min | 0 | 0 | 10 |
| 180° C. × 4 min | 0 | 0 | 20 |

TABLE 6

| Drying Condition | Counted Number of Pin Holes, Layer Thickness 30 μm | 40 μm | 50 μm |
|---|---|---|---|
| 130° C. × 12 min | 0 | 0 | 5 |
| 140° C. × 10 min | 0 | 3 | 10 |
| 150° C. × 8 min | 2 | 20 | Whole Surface |
| 160° C. × 6 min | 0 | Almost | Whole |

TABLE 6-continued

| Drying Condition | Counted Number of Pin Holes, Layer Thickness 30 μm | 40 μm | 50 μm |
|---|---|---|---|
| | | Whole Surface | Surface |
| 170° C. × 5 min | Almost Whole Surface | Whole Surface | Whole Surface |
| 180° C. × 4 min | Whole Surface | Whole Surface | Whole Surface |

TABLE 7

| Drying Condition | Counted Number of Pin Holes, Layer Thickness 30 μm | 40 μm | 50 μm |
|---|---|---|---|
| 130° C. × 12 min | 0 | 0 | 0 |
| 140° C. × 10 min | 0 | 0 | 0 |
| 150° C. × 8 min | 0 | 0 | 0 |
| 160° C. × 6 min | 0 | 0 | 0 |
| 170° C. × 5 min | 0 | 0 | 8 |
| 180° C. × 4 min | 0 | 0 | 25 |

TABLE 8

| Drying Condition | Counted Number of Pin Holes, Layer Thickness 30 μm | 40 μm | 50 μm |
|---|---|---|---|
| 130° C. × 12 min | 0 | 0 | 0 |
| 140° C. × 10 min | 0 | 0 | 0 |
| 150° C. × 8 min | 0 | 0 | Almost Whole Surface |
| 160° C. × 6 min | 5 | 50 or more | Almost Whole Surface |
| 170° C. × 5 min | Almost Whole Surface | Whole Surface | Whole Surface |
| 180° C. × 4 min | Whole Surface | Whole Surface | Whole Surface |

TABLE 9

| Comparative Test Between Two Heating Devices: Period (Min' Sec") | Only Hot Air | Hot Air + IR |
|---|---|---|
| 00' 20" | | 69.0° C. |
| 00' 30" | 44.5° C. | |
| 00' 40" | | 100.0° C. |
| 00' 50" | | |
| 01' 10" | 56.5° C. | 130.0° C. |
| 01' 20" | | 140.0° C. |
| 01' 20" | | 152.0° C. |
| 01' 30" | 66.0° C. | 162.0° C. |
| 02' 00" | 73.5° C. | |
| 02' 30" | 80.5° C. | |
| 03' 00" | 85.5° C. | |
| 03' 30" | 89.0° C. | |
| 04' 00" | 92.5° C. | |
| 04' 30" | 95.0° C. | |
| 05' 00" | 97.0° C. | |

Heated Material:
Bonderized Steel Plate
Thickness 2.3 mm, Size 100 mm × 100 mm
Distance between IR Lamp and Sample: 20 cm
Temperature of Hot Air: 105° C.
Room Temperature: 21° C.

TABLE 10

| Coating Material | Hot Air Furnance: Air Temperature (°C.) | Heating Time (hour° min') | Hardness |
|---|---|---|---|
| 1 Melamine resin | 150 | 15° 00' | H |
| 2 Acrylic resin | 170 | 18° 00' | 2H |
| 3 Polyester resin (Powder) | 200 | 20° 00' | 3H |
| 4 Fluoro resin | 160 | 20° 00' | 3H |

TABLE 10-continued

| Coating Material | Air Temperature (°C.) | Heating Time | Hardness |
|---|---|---|---|
| | Embodiment A1 | | |
| | | (hour:Min) | |
| 1 Melamine resin | 150 | 1° 20′ | H |
| 2 Acrylic resin | 170 | 1° 00′ | 2H |
| 3 Polyester resin (Powder) | 200 | 3° 00′ | 3H |
| 4 Fluoro resin | 160 | 4° 30′ | 3H |

TABLE 11

| Air Velocity (m/sec) | Air Temperature of Air Curtain (°C.) 50 | 70 | 90 | 100 | 110 | 120 | 160 |
|---|---|---|---|---|---|---|---|
| 4 | ○ | ○ | ○ | Δ | Δ | X | X |
| 7 | ○ | ○ | Δ | Δ | X | X | X |
| 10 | ○ | ○ | Δ | X | X | X | X |

○ → No Pin Holes
Δ → A few Pin Holes
X → Many Pin Holes

TABLE 12

| Coating Material | Air Temperature (°C.) | Heating Time (hour° min′) | Hardness |
|---|---|---|---|
| | Conventional Furnance (Hot Air) | | |
| 1 Melamine resin | 150 | 15° 00′ | H |
| 2 Acrylic resin | 170 | 18° 00′ | 2H |
| 3 Polyester resin (Powder) | 200 | 20° 00′ | 3H |
| 4 Fluoro resin | 160 | 20° 00′ | 3H |
| | Embodiment B & C (Hot Air + Near IR) | | |
| 1 Melamine resin | 150 | 1° 30′ | H |
| 2 Acrylic resin | 170 | 1° 00′ | 2H |
| 3 Polyester resin (Powder) | 200 | 4° 30′ | 3H |
| 4 Fluoro resin | 150 | 5° 30′ | 3H |

TABLE 13

| Only Near IR | | Hot Air + Near IR 100° C. | | 170° C. | |
|---|---|---|---|---|---|
| Time (hour° min′) | Hardness | Time (hour° min′) | Hardness | Time (hour° min′) | Hardness |
| | | 1° 00′ | F | 1° 00′ | 2H |
| | | 1° 30′ | H | 1° 30′ | 3H |
| 2° 00′ | 5B | 2° 00′ | 2H | 2° 30′ | 3H |
| 3° 00′ | 2B | | | | |
| 5° 00′ | F | | | | |
| 7° 00′ | H | | | | |
| 9° 00′ | 2H | | | | |

What is claimed is:

1. A method for drying a coated layer formed on a substrate comprising the steps of:

(a) applying near infrared radiation to said coated layer for a predetermined period of time;

(b) allowing said substrate to be heated by a portion of said near infrared radiation which is transmitted through said coated layer and which is absorbed by said substrate;

(c) heating the coated layer via its interface with said heated substrate such that any solvent in said coated layer is evaporated before said coated layer is dried and the dried coated layer is free from having any pin holes therein.

2. A method for drying as recited in claim 1, wherein during step (a) said near infrared radiation being applied to said coated layer has an energy peak at $<2$ μm.

3. A method for drying as recited in claim 2, further comprising blowing hot air on said coated layer concurrent with step (a).

4. A method for drying as recited in claim 3, further comprising ascertaining said predetermined period of time and a temperature of said hot air based on the material used as said coated layer.

5. A method for drying as recited in claim 4, wherein during step (a) said near infrared radiation being applied to said coated layer has an energy peak within a range of 1.2 μm to 1.5 μm.

6. A method for drying as recited in claim 5, wherein said coated layer is made from one of an acrylic resin, a urethane resin, an epoxy resin and a melamine resin, and said substrate is a metal.

7. A method as recited in claim 6, wherein said substrate is made from one of iron, aluminum, copper, brass, gold, beryllium, molybdenum, nickel, lead, rhodium, silver, tantalum, antimony, cadmium, chromium, iridium, cobalt, magnesium, and tungsten.

8. A drying apparatus for drying a coated layer on a substrate, said apparatus comprising:

a housing;

means for heating said coated layer such that any solvent in said coated layer is evaporated before said coated layer dries, and when said coated layer dries it is free of pin holes, said heating means including a first infrared radiator disposed in said housing which generates a first near infrared radiation onto said coated layer and said substrate such that said substrate is heated by said first near infrared radiation and said coated layer is heated by said heated substrate.

9. An apparatus as set forth in claim 8, wherein said first near infrared radiation has an energy peak at $<2$ μm.

10. An apparatus as recited in claim 9, further comprising a hot air blower operatively connected to said first radiator such that said hot air blower and said first radiator operate concurrently, and wherein said hot air blower applies hot air to said coated layer.

11. An apparatus as recited in claim 10, wherein said hot air and said first near infrared radiation are applied to a same portion of said coated layer.

12. An apparatus as recited in claim 11, wherein said first near infrared radiation has an energy peak in a range between 1.2 μm to 1.5 μm.

13. An apparatus as recited in claim 12, wherein said substrate is made from one of iron, aluminum, copper, brass, gold, beryllium, molybdenum, nickel, lead, rhodium, silver, tantalum, antimony, cadmium, chromium, iridium, cobalt, magnesium, and tungsten and said coated layer is made from one of an acrylic resin, a urethane resin, an epoxy resin and a melamine resin.

14. An apparatus as recited in claim 13, further comprising a reflector and wherein said first radiator includes an infrared lamp disposed within said reflector such that said first near infrared radiation is reflected by said reflector in a predetermined direction.

15. An apparatus as recited in claim 14, wherein said blower blows said hot air in said predetermined direction.

16. An apparatus as recited in claim 14, wherein said reflector is parabolic in shape such that said first near infrared radiation is reflected as individual beams which are parallel to each other.

17. An apparatus as recited in claim 14, wherein said reflector is hyperbolic in shape such that said first near infrared radiation is reflected as individual beams in a radial array.

18. An apparatus as recited in claim 14, further comprising at least a second infrared radiator disposed in said housing which generates a second near infrared radiation onto said coated layer, and wherein said blower blows said hot air in a direction perpendicular to a direction of said first and second near infrared radiations.

19. An apparatus as recited in claim 18, wherein said housing is a tunnel shaped furnace.

20. An apparatus as recited in claim 19, wherein said housing has an inlet opening, and further comprising an air curtain disposed proximate to said inlet opening and a temperature control means for sensing and controlling the temperature of said air curtain.

21. A drying apparatus for drying a coated layer on a substrate, said apparatus comprising:

a housing;

a first infrared radiator disposed in said housing which generates a first near infrared radiation onto said coated layer such that any solvent in said coated layer is evaporated before said coated layer dries, and when said coated layer dries it is free of pin holes;

a reflector and wherein said first radiator includes an infrared lamp disposed within said reflector such that said first near infrared radiation is reflected by said reflector in a predetermined direction;

a telescopic head which is slidably mounted on said reflector; and a hot air blower operatively connected to said first radiator such that said hot air blower and said first radiator operate concurrently, and wherein said hot air blower applies hot air to said coated layer;

wherein said hot air and said first near infrared radiation are applied to a same portion of said coated layer;

wherein said first near infrared radiation has an energy peak in a range between 1.2 μm to 1.5 μm;

wherein said substrate is made from one of iron, aluminum, copper, brass, gold, beryllium, molybdenum, nickel, lead, rhodium, silver, tantalum, antimony, cadmium, chromium, iridium, cobalt, magnesium, and tungsten and said coated layer is made from one of an acrylic resin, a urethane resin, an epoxy resin and a melamine resin;

wherein said reflector is parabolic in shape such that said first near infrared radiation is reflected as individual beams which are parallel to each other.

22. An apparatus as recited in claim 21, wherein said housing has a handle formed therein which allows said apparatus to be hand carried.

23. An apparatus as recited in claim 22, wherein said telescopic head has at least one slit therein through which said hot air is discharged.

24. A method for drying a coated layer formed on a substrate comprising the steps of:

(a) applying infrared radiation to said coated layer for a predetermined period of time, said infrared radiation having a high transmissivity relative to said coated layer and a high absorptivity relative to said substrate;

(b) allowing said substrate to be heated by a portion of said infrared radiation which is transmitted through said coated layer and which is absorbed by said substrate;

(c) heating the coated layer via its interface with said heated substrate such that any solvent in said coated layer is evaporated before said coated layer is dried and the dried coated layer is free from having any pin holes therein.

25. A method for drying a coated layer having first and second opposed surfaces, the coated layer being formed on a substrate such that the first surface contacts the substrate, the method comprising the steps of:

(a) applying infrared radiation to the coated layer, the infrared radiation having a high transmissivity relative to the coated layer and a high absorptivity relative to the substrate;

(b) absorbing the infrared radiation in the substrate such that the substrate is heated;

(c) heating the coated layer via its interface at the first surface with the heated substrate such that the coated layer gradually solidifies from the first surface toward the second surface; and (d) blowing hot air in a direction substantially perpendicular to a radiated direction of the applied infrared radiation.

26. A drying apparatus for drying a coated layer on a substrate, said apparatus comprising:

a housing having an inlet opening;

means for heating said coated layer such that any solvent in said coated layer is evaporated before said coated layer dries, and when said coated layer dries it is free of pinholes, said heating means including a first infrared radiator disposed in said housing which generates a first near infrared radiation onto said coated layer and said substrate such that said substrate is heated by said first near infrared radiation and said coated layer is heated by said heated substrate;

a hot air blower operatively connected to said first radiator such that said hot air blower and said first radiator operate concurrently and wherein said hot air blower applies hot air to said coated layer;

means for creating an air curtain which is distinct from said hot air and which is disposed proximate to said inlet opening; and a temperature control means for sensing and controlling the temperature of said air curtain.

27. An apparatus as recited in claim 26, wherein said hot air blower applies hot air to said coated layer in a direction which is perpendicular to a radiated direction of said first near infrared radiation.

28. A drying apparatus for drying a coated layer on a substrate, said apparatus comprising:

a housing;

a first infrared radiator disposed in said housing which generates a first near infrared radiation onto said coated layer such that any solvent in said coated layer is evaporated before said coated layer dries, and when said coated layer dries it is free of pin holes;

a reflector;

a telescopic head which is slidably mounted on said reflector;

wherein said first radiator includes an infrared lamp disposed within said reflector such that said first near infrared radiation is reflected by said reflector in a predetermined direction.

* * * * *